US005257916A

United States Patent [19]

Tuckey

[11] Patent Number: 5,257,916

[45] Date of Patent: Nov. 2, 1993

[54] REGENERATIVE FUEL PUMP

[75] Inventor: Charles H. Tuckey, Cass City, Mich.

[73] Assignee: Walbro Corporation, Cass City, Mich.

[21] Appl. No.: 982,584

[22] Filed: Nov. 27, 1992

[51] Int. Cl.[5] ..... F04B 17/00

[52] U.S. Cl. ..... 417/423.3; 417/423.4; 415/55.2

[58] Field of Search ..... 417/423.30, 423.14; 415/55.1, 55.2, 55.3

[56] References Cited

U.S. PATENT DOCUMENTS

| | | | |
|---|---|---|---|
| 4,586,877 | 5/1986 | Watanabe et al. | 417/423.3 |
| 4,784,587 | 11/1988 | Takei et al. | 417/423.6 |
| 4,822,258 | 4/1989 | Matsuda et al. | 417/423.3 |
| 5,160,249 | 11/1992 | Iwai et al. | 415/55.2 |

*Primary Examiner*—Richard A. Bertsch
*Assistant Examiner*—Alfred Basichas
*Attorney, Agent, or Firm*—Barnes, Kisselle, Raisch, Choate, Whittemore & Hulbert

[57] ABSTRACT

An electric-motor regenerative fuel pump that includes a housing with a fuel inlet and a fuel outlet, and an electric motor with a rotor responsive to application of electrical power for rotating within the housing. A pump mechanism includes an impeller coupled to the rotor for corotation therewith and having a periphery with a circumferential array of open impeller vanes. An arcuate pumping channel surrounds the impeller periphery, and is operatively coupled by inlet and outlet ports at opposed ends of the channel to the inlet and outlet in the pump housing. The pumping channel has a circumferential array of radially curved grooves axially opposed to the impeller periphery and extending radially inwardly from the impeller vanes. A circumferential rib extends radially into the pumping channel opposed to the impeller periphery, and has arcuate dimension within the channel that coincides with the dimension of the channel groove array.

26 Claims, 3 Drawing Sheets

REGENERATIVE FUEL PUMP

The present invention is directed to electric-motor fuel pumps, and more particularly to a regenerative fuel pump for automotive engine and like applications.

BACKGROUND AND OBJECTS OF THE INVENTION

Electric-motor regenerative pumps have heretofore been proposed and employed in automotive fuel delivery systems. Pumps of this character typically include a housing adapted to be immersed in a fuel supply tank with an inlet for drawing fuel from the surrounding tank and an outlet for feeding fuel under pressure to the engine. An electric motor includes a rotor mounted for rotation within the housing and connected to a source of electrical energy for driving the rotor about its axis of rotation. An impeller is coupled to the rotor for corotation therewith, and has a circumferential array of vanes around the periphery of the impeller. An arcuate pumping channel with an inlet port and an outlet port at opposed ends surrounds the impeller periphery for developing fuel pressure through a vortex-like action between the pockets formed by the impeller vanes and the surrounding channel. One example of a fuel pump of this type is illustrated in U.S. Pat. No. 3,259,072.

Fuel pumps of this character are subject to a number of design criteria for automotive applications. For example, the fuel pump may be required to deliver fuel at or above a minimum specified flow rate at specified pressure under nominal or normal operating conditions of temperature and battery voltage. The fuel pump may also be required to deliver a specified pressure and minimum flow under low battery voltage conditions, which may occur when it is attempted to start an engine at extremely low temperature. Another design requirement may be to deliver fuel at specified flow rate and minimum pressure under high temperature conditions in which vapor from the hot fuel can play a significant role. Design features and parameters intended to improve performance under some operating conditions can deleteriously affect operation under other conditions.

A general object of the present invention is to provide an electric-motor regenerative fuel pump of the described character that features improved performance under a variety of operating conditions, including normal operating conditions, cold starting conditions and hot fuel handling conditions as described above. Another object of the present invention is to provide a pump of the described character that is quiet, economical to manufacture and assemble, and achieves consistent and reliable performance over an extended operating lifetime.

SUMMARY OF THE INVENTION

An electric-motor regenerative fuel pump in accordance with the present invention includes a housing having a fuel inlet and a fuel outlet, and an electric motor with a rotor responsive to application of electrical power for rotation within the housing. A pump mechanism includes an impeller coupled to the rotor for corotation therewith and a circumferential array of vanes extending around the periphery of the impeller. An arcuate pumping channel surrounds the impeller periphery, and is operatively coupled to the fuel inlet and outlet of the housing for delivering fuel under pressure to the housing outlet. The pumping channel has a circumferential array of radial grooves that form channel vanes between the grooves axially opposed to the impeller periphery. The channel grooves extend radially inwardly of the impeller vanes, and have been found to provide enhanced pump performance, particularly under hot fuel conditions. Although the reasons for the improved performance provided by the channel grooves and vanes are not fully understood, it is believed that the channel vanes create turbulence and reduce velocity of the fuel as the fuel is pumped through the arcuate pumping channel, enhancing vortex action and/or regenerative pumping action on the fuel, especially at low voltage and pump speed conditions.

In the preferred embodiment of the invention, the circumferential array of channel grooves extends only partway around the arcuate pumping channel, being disposed adjacent to the outlet port at the downstream end of the pumping channel. The upstream end of the pumping channel adjacent to the inlet port is of substantially constant cross section (i.e., no channel grooves), with the average cross sectional area of the downstream region of the pumping channel with the channel vanes being greater than the cross sectional area of the upstream channel region. A vapor port opens into the upstream region of the pumping channel immediately adjacent to the downstream region. The channel grooves, and the channel vanes between the channel grooves, preferably are angulated radially in a direction opposed to rotation of the impeller. In the preferred embodiment of the invention, the channel grooves and vanes are of arcuate geometry radially of the impeller, and have a depth in the axial direction that increases radially inwardly of the impeller periphery. The portions of the channel grooves that extend radially inwardly of the impeller vanes have a radial dimension that is substantially equal to the radial dimension of the impeller vanes themselves.

In the preferred embodiment of the invention, a rib extends radially into the arcuate pumping channel opposed to the impeller periphery. Both the rib and the array of channel grooves extend partway around the pumping channel adjacent to the outlet port, the ribs and array being of substantially identical angular dimension. Preferably, the impeller vanes comprise so-called open vanes in which the bottom surface of each vane pocket formed in one axial face of the impeller intersects the bottom surface of the axially adjacent pocket in the opposing impeller face radially inwardly of the impeller periphery. The impeller pockets in the preferred embodiment of the invention are of curvilinear concave construction. The combination of this open vane impeller construction, the radial channel rib and the radial channel grooves adjacent to the outlet port of the pumping channel has been found to yield enhanced cold starting performance and hot fuel handling performance, while meeting or exceeding desired minimum performance characteristics at normal operating conditions.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
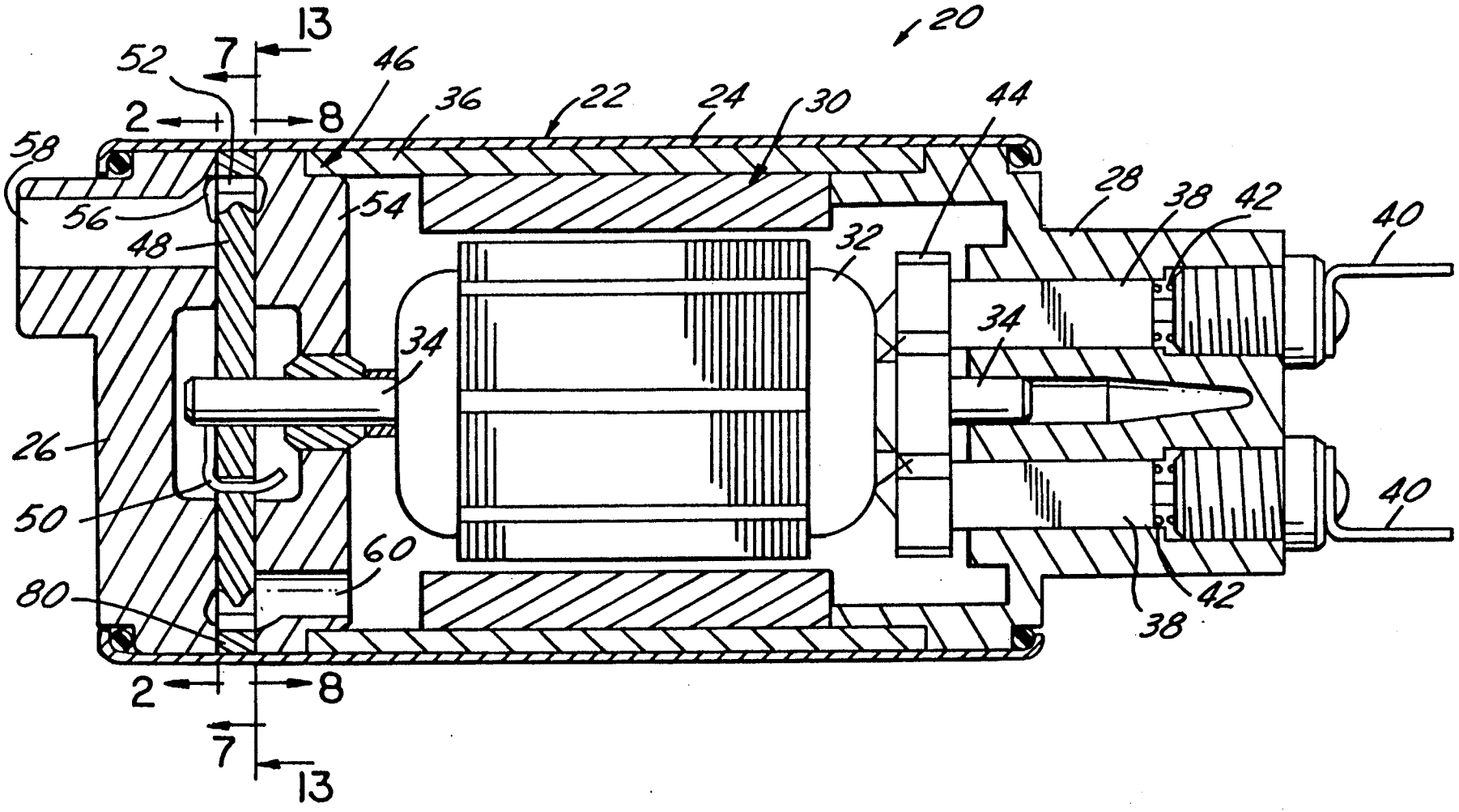
FIG. 1 is a sectional view in side elevation illustrating an electric-motor fuel pump in accordance with a presently preferred embodiment of the invention.

FIG. 1 illustrates an electric-motor fuel pump 20 in accordance with a presently preferred embodiment of the invention as comprising a housing 22 formed by a cylindrical case 24 that joins axially spaced inlet and outlet end caps 26,28. An electric motor 30 is formed by a rotor 32 journaled by a shaft 34 for rotation within housing 22, and by a surrounding permanent magnet stator 36. Brushes 38 are disposed within outlet end cap 28 and electrically connected to terminals 40 positioned externally of end cap 28. Brushes 38 are urged by springs 42 into electrical sliding contact with a commutator plate 44 carried by rotor 32 and shaft 34 within housing 12. To the extent thus far described, pump 10 is generally similar to those disclosed in U.S. Pat. Nos. 4,352,641, 4,500,270 and 4,596,519.

The pump mechanism 46 of pump 20 includes an impeller 48 coupled to shaft 34 by a wire 50 for corotation therewith. An arcuate pumping channel 52 circumferentially surrounds the periphery of impeller 48, and is formed by inlet end cap 26 and a plate 54 on the opposite side of impeller 48, which thus form the impeller side plates, and by a ring 80 that is sandwiched in assembly between plates 26,54 surrounding impeller 48. Pumping channel 50 has an axially opening inlet port 56 at one end connected to the inlet 58 that projects from end cap/side plate 26, and has an axially opening outlet port 60 at the opposing end through plate 54 to the interior of housing 22. Fuel is thereby pumped by impeller 48 from inlet 58 through housing 22 to an outlet on end cap 28.

Figure 2:
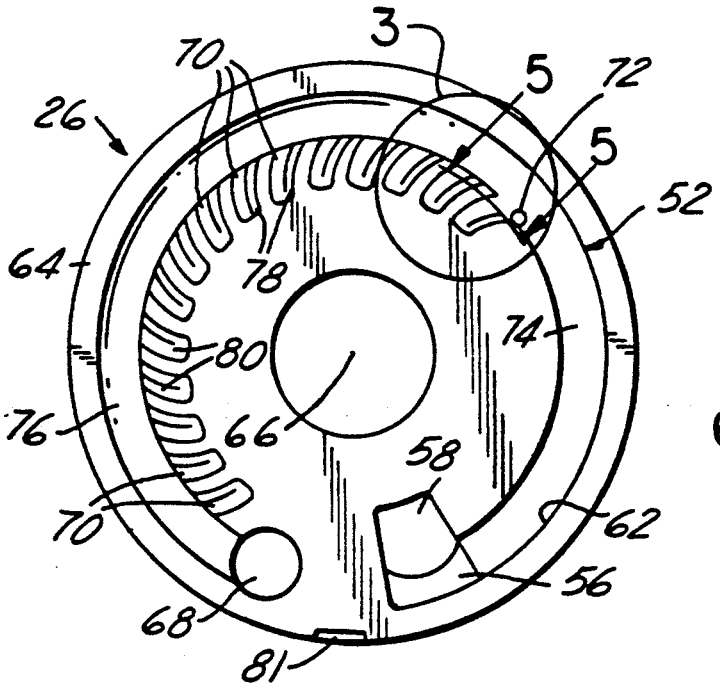
FIG. 2 is a side elevational view of the inside face of the pump inlet end cap/side plate, being taken substantially along the line 2—2 in FIG. 1.
Figure 3:
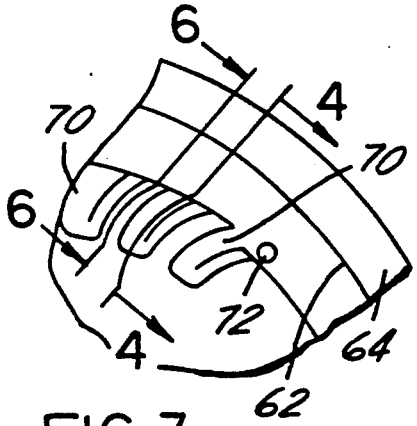
FIG. 3 is a fragmentary view on an enlarged scale of the portion of FIG. 2 within the circle 3.
Figure 5:
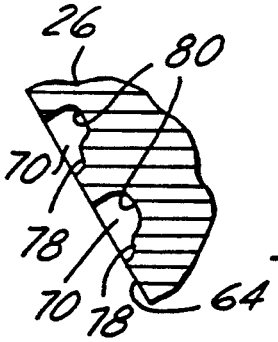
FIGS. 4–6 are fragmentary sectional views taken substantially along the respective lines 4—4, 5—5 and 6—6 in FIGS. 2 and 3.
Figure 4:
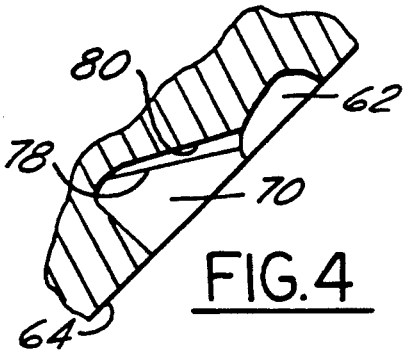
Figure 6:
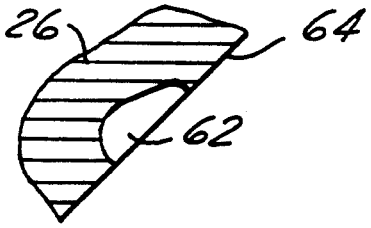
Figure 8:
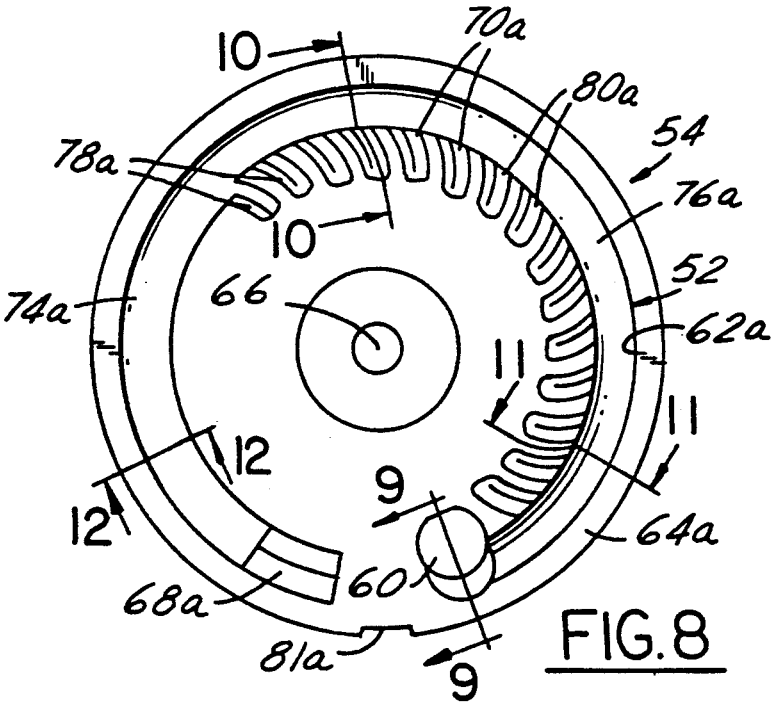
FIG. 8 is a side elevational view of the inside face of the inner side plate in the pump of FIG. 1, being taken substantially along the line 8—8 in FIG. 1.

Side plates 26,54 are illustrated in greater detail in FIGS. 2 and 8 respectively, and in the fragmentary views of FIGS. 3–6 and 9. Arcuate pumping channel 52 is defined in part by an arcuate channel section 62 on the flat inside face 64 of end cap/side plate 26. As shown in FIG. 2, channel section 62 extends from inlet port 56 around face 64 at constant radius from the central axis 66 of the pump/motor, to a pocket 68 angularly adjacent to but spaced from inlet port 58. A circumferential array of generally radially oriented arcuate grooves 70 are formed in face 64 and extend radially inwardly from channel section 62. Each groove 70 widens axially as it extends radially inwardly from channel section 62, as best seen in FIG. 4. The array of grooves 70 extends over less than the entire arcuate length of channel section 62, from adjacent pocket 68 over about one-half of the channel length. A vapor port 72 opens to channel section 62 adjacent to the leading edge of grooves 70—i.e., at the edge of the groove array proximate to inlet port 56. There is thus formed, in effect, a two-region channel section 62 that includes a first or upstream region 74 adjacent to inlet port 56, and a second or downstream region 76 adjacent to pocket 68. Grooves 70 are curved in a direction opposed to travel from inlet port 56 to pocket 68. As best seen in FIG. 5, each groove 70 is of stepped cross sectional counter, having a leading upstream relatively shallow portion 78 and a deeper downstream portion 80.

Figure 9:
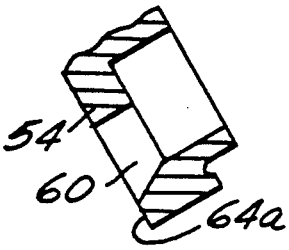
FIG. 9 is a fragmentary sectional view taken substantially along the line 9—9 in FIG. 8.

Pumping channel 52 is also defined in part by an arcuate channel section 62*a* that extends between outlet port 60 and a pocket 68*a* in the inner face 64*a* of side plate 54 (FIGS. 8–9). In assembly, the notches 81,81*a* in end cap/side plate 26 and side plate 54 are aligned so that pocket 68*a* in side plate 54 opposes inlet port 56 in side plate 26, and pocket 68 in side plate 26 opposes outlet port 60 in side plate 54. With the exception of vapor port 72 in end cap/side plate 26, which finds no correspondence in side plate 54, the arrangement of channels and grooves in side plate 54 is the mirror image of that in side plate 26, and the corresponding elements in FIG. 8 are indicated by correspondingly identical reference numerals followed by the suffix "a".

Figure 13:
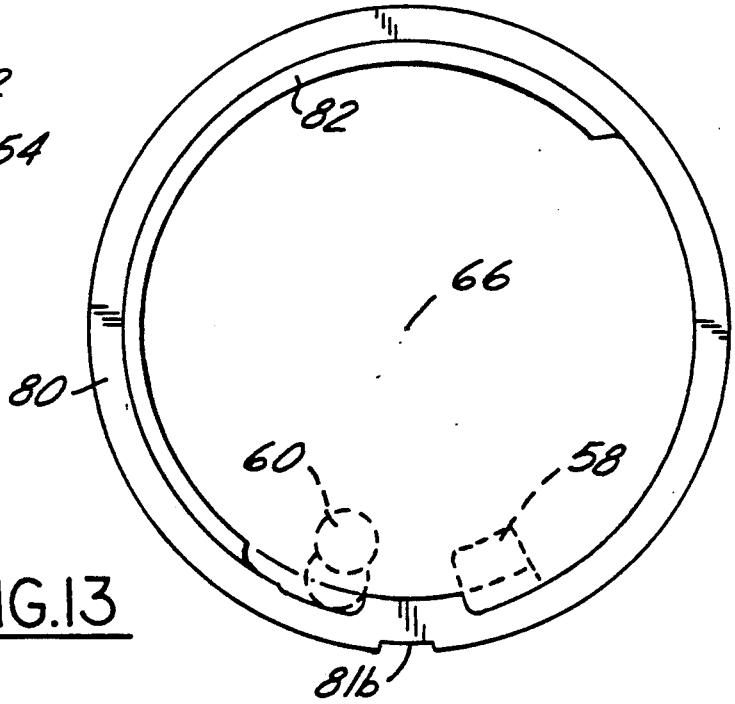
FIG. 13 is a side elevational view of the impeller guide ring, being taken substantially along the line 13—13 in FIG. 1.

Pumping channel 52 is also defined in part by the impeller guide ring 80 (FIGS. 1 and 13) that is sandwiched in assembly between end cap/side plate 26 and interior side plate 54 radially surrounding impeller 48. Ring 80 has a radially inwardly projecting rib 82 that extends to the periphery of impeller 48, being spaced therefrom only sufficiently to permit rotation of the impeller without contact with the ring. Rib 82 is axially centrally disposed between the side plates, and has an arcuate dimension coextensive in assembly with the mirror image arrays of channel grooves 70,70*a* in side plates 26,54. That is, rib 82 does not extend into the channel section defined by upstream portions 74,74*a*, and does not overlie or obstruct outflow of fuel through outlet port 60. A notch 81*b* (FIG. 13) in ring 80 cooperates with notch 81 in plate 26 and notch 81*a* in plate 54 to align the components in assembly.

Figure 7:
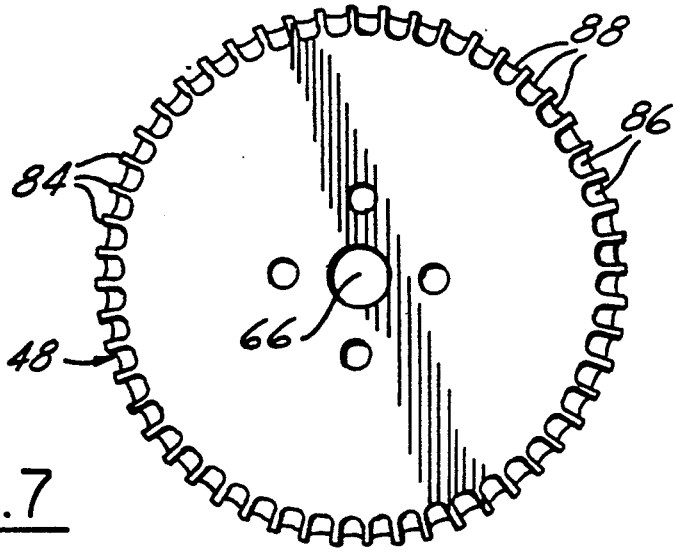
FIG. 7 is a side elevational view of the pump impeller in the preferred embodiment of FIG. 1, being taken substantially along the line 7—7 in FIG. 2.
Figure 10:
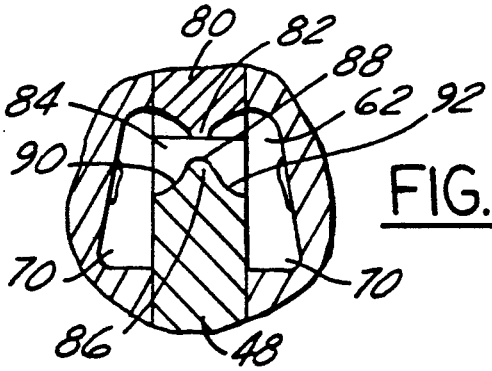
FIGS. 10–12 are fragmentary sectional views of the pump mechanism, being taken substantially at the angular positions 10—10, 11—11 and 12—12 in FIG. 8.
Figure 11:
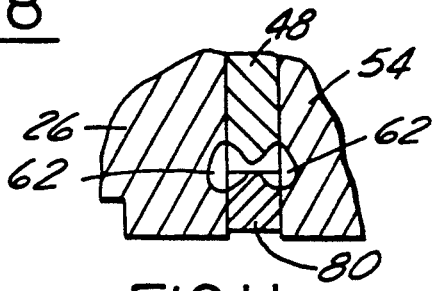
Figure 12:
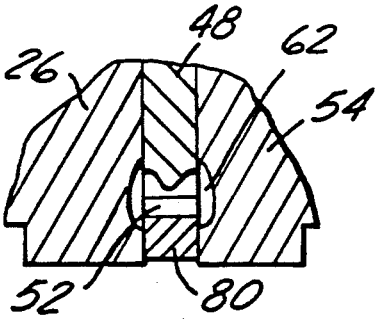

Impeller 48 comprises a flat disk having radially projecting vanes 84 (FIG. 7) of uniform thickness and angular spacing, and having outer edges that define the periphery of the impeller concentric with axis 66. Between each pair of vanes 84, a rib 86 projects radially outwardly, terminating short of the impeller periphery in a rounded radially outer edge 88. All ribs 86 are identical and disposed centrally of the impeller body, and outer edges 88 are concentric with axis 66. Vanes 84 and ribs 86 thus form circumferential arrays of axially and radially open pockets at the peripheral edge of each impeller side face. Impeller 48 is a so-called open vane impeller in which the bottom surface 90 (FIG. 10) of each vane pocket formed on one axial impeller face intersects the bottom surface 92 of the pocket formed on the opposing face, the two surfaces meeting at rounded rib outer edge 88. Preferably, each rib 86 has a maximum radial dimension equal to about two-thirds of the maximum radial dimension of the vanes 84.

In assembly of end cap/side plate 26, interior side plate 54, ring 80 and impeller 48, there is thus formed pumping channel 52 having a first arcuate segment formed by channel regions 74,74*a* of constant cross sectional area extending from inlet port 56, and a second arcuate channel segment formed by channel regions 76,76*a* adjacent to outlet port 60 in which the channel grooves 70,70*a* and the ring rib 82 are disposed. The average cross sectional area of the channel segment formed by regions 76,76*a* is greater than the cross sectional area of the channel segment formed by regions 74,74*a*. In a working embodiment of the invention, by way of example, the cross sectional area of the downstream channel segment formed by regions 76,76*a* varies between 10.12mm$^2$ at channel grooves 70,70*a*, and 4.29mm$^2$ between adjacent channel grooves 70,70*a*. Taking cord length into consideration, the average cross sectional area is 7.22mm$^2$, as compared with a cross sectional area of 6.34mm$^2$ in the upstream channel region defined by channel segments 74,74*a*. In operation, impeller 48 pumps fuel from inlet port 56 around pumping channel 52 to outlet port 60 by the vortex and regenerative pumping action characteristic of this type of pump.

The fuel pump herein disclosed has been found to exhibit superior cold starting and hot fuel handling performance. Provision of the channel vanes formed by grooves 70,70*a*, in combination with the open vane construction of impeller 48, has been found dramatically to improve cold starting performance and substantially to improve hot fuel handling capabilities. Provision of rib 86, in combination with the open vane construction of impeller 48, has been found to improve hot fuel handling capabilities and substantially to improve cold starting performance. The combination of all three elements—i.e., the channel vanes formed by grooves 70,70*a*, rib 86 and the open vane construction of impeller 48—dramatically increases both cold starting performance and hot fuel handling capabilities over pump constructions not having these elements, without significantly detracting from performance under normal conditions. The stepped cross section of grooves 70,70*a* (best seen in FIG. 5) has been found to improve performance over channel grooves of uniform cross section. It is believed that fluid enters each channel 70,70*a* moving radially inwardly along the deeper channel portion 80, and then exits the channels by moving radially outwardly along shallower portion 78. The angle (FIG. 4) of portion 78 is such as to guide the fluid back into the open impeller vanes. The impeller, ring and side plates may be molded of desired composition, such as ceramic.

I claim:

1. An electric-motor fuel pump that comprises:

a housing including a fuel inlet and a fuel outlet, an electric motor including a rotor and means for applying electrical energy to said motor to rotate said rotor within said housing, and pump means including an impeller coupled to said motor for corotation therewith and having a periphery with a circumferential array of vanes, and means forming an arcuate pumping channel surrounding said impeller periphery and coupled to said inlet and outlet, said pumping channel including a circumferential array of radial grooves axially opposed to said impeller periphery, said channel grooves extending radially inwardly of said impeller vanes.

2. The pump set forth in claim 1 wherein said circumferential array of channel grooves extends partway around said pumping channel for less than the entire arcuate length of said pumping channel.

3. The pump set forth in claim 2 wherein said means forming said pumping channel includes means forming channel inlet and outlet ports at opposed ends of said arcuate channel, said array of radial channel grooves being disposed adjacent to said outlet port.

4. The pump set forth in claim 3 wherein said pumping channel has a first arcuate region adjacent to said inlet port of substantially constant cross section and a second arcuate region adjacent to said outlet port in which said channel grooves are disposed, average cross sectional area of said second region being greater than cross sectional area of said first region.

5. The pump set forth in claim 4 wherein said means forming said pumping channel further includes means forming a vapor port opening into said first region adjacent to said second region.

6. The pump set forth in claim 5 wherein said second region comprises substantially one-half of the arcuate dimension of said pumping channel.

7. The pump set forth in claim 1 wherein said channel grooves are angulated radially in a direction opposed to direction of rotation of said impeller.

8. The pump set forth in claim 7 wherein said channel grooves are of arcuate geometry radially of said impeller.

9. The pump set forth in claim 8 wherein axial depth of said channel grooves increases radially inwardly of said impeller periphery.

10. The pump set forth in claim 8 wherein said impeller vanes are of uniform radial dimension, and wherein said channel grooves extend radially inwardly of said impeller vanes a distance substantially equal to said radial dimension.

11. The pump set forth in claim 1 wherein said circumferential array of radial grooves comprises first and second arrays of said radial grooves on axially opposed sides of said channel, said first and second arrays being mirror images of each other.

12. The pump set forth in claim 1 wherein said means forming said arcuate pumping channel includes a circumferential rib that extends radially into said channel opposed to said impeller periphery.

13. The pump set forth in claim 12 wherein both said circumferential array of channel grooves and said rib circumferential extend partway around said pumping channel for less than the entire arcuate length of said pumping channel.

14. The pump set forth in claim 13 wherein said means forming said pumping channel includes channel inlet and outlet ports at opposed ends of said pumping channel, both said array of channel grooves and said rib being disposed adjacent to said outlet port.

15. The pump set forth in claim 14 wherein said array of radial channel grooves and said rib are of substantially identical arcuate dimension.

16. The pump set forth in claim 1 wherein said plurality of vanes on said impeller comprise open vanes.

17. The pump set forth in claim 16 wherein said open vanes comprise circumferential arrays of axially facing pockets on opposed axial side faces of said rotor, each said pocket on each said face opening within said periphery to an axially adjacent pocket on the opposing said face.

18. The pump set forth in claim 17 wherein said impeller has a circumferential rib between adjacent vanes that separates axially adjacent pockets from each other, said rib having a radially outer edge disposed within said periphery.

19. The pump set forth in claim 18 wherein said radially outer edge is of generally uniform radial dimension.

20. The pump set forth in claim 18 wherein each said pocket is of curvilinear arcuate construction.

21. An electric-motor fuel pump that comprises:

a housing including a fuel inlet and a fuel outlet, an electric motor including a rotor and means for applying electrical energy to said motor to rotate said rotor within said housing, and pump means including an impeller coupled to said rotor for corotation therewith and having a periphery with a circumferential array of open vanes, and means forming an arcuate pumping channel surrounding said impeller periphery and coupled to said inlet and outlet, said pumping channel including a circumferential array of radial channel grooves axially opposed to said impeller periphery, said channel grooves extending radially inwardly of said impeller vanes, said means forming said arcuate pumping channel further including a circumferential rib that centrally extends radially into said channel opposed to said impeller periphery.

22. The pump set forth in claim 21 wherein both said circumferential array of channel grooves and said rib extend part way around said pumping channel for less than the entire arcuate length of said pumping channel.

23. The pump set forth in claim 22 wherein said means forming said pumping channel includes channel inlet and outlet ports at opposed ends of said pumping channel, both said array of channel grooves and said rib being disposed adjacent to said outlet port.

24. The pump set forth in claim 23 wherein said array of radial channel grooves and said rib are of substantially identical arcuate dimension.

25. The pump set forth in claim 24 wherein said channel grooves are angulated radially in a direction opposed to direction of rotation of said impeller.

26. The pump set forth in claim 25 wherein said channel grooves are of arcuate geometry radially of said impeller.

* * * * *